US005887658A

United States Patent [19]

Tison

[11] Patent Number: 5,887,658

[45] Date of Patent: Mar. 30, 1999

[54] OIL WELL PRODUCTION STRING HANGER

[75] Inventor: Marc Tison, Arbus, France

[73] Assignee: Elf Exploration Production, France

[21] Appl. No.: 891,869

[22] Filed: Jul. 9, 1997

[30] Foreign Application Priority Data

Jul. 9, 1996 [FR] France ..... 96 08504

[51] Int. Cl.[6] ..... E21B 43/14

[52] U.S. Cl. ..... 166/348; 166/382

[58] Field of Search ..... 166/97.5, 367, 166/341, 348, 382, 344

[56] References Cited

U.S. PATENT DOCUMENTS

| | | | |
|---|---|---|---|
| 3,360,048 | 12/1967 | Watkins | 166/87 |
| 3,468,559 | 9/1969 | Ahlstone | 285/18 |
| 3,625,283 | 12/1971 | Ahistone | 166/87 |
| 3,861,463 | 1/1975 | Crowe | 166/367 |
| 4,077,472 | 3/1978 | Gano | 166/315 |
| 4,089,377 | 5/1978 | Chateau | 166/315 |
| 4,133,378 | 1/1979 | Gano | 166/85 |
| 4,139,058 | 2/1979 | Gano | 166/85 |
| 4,223,738 | 9/1980 | Boutet et al. | 166/368 |
| 4,298,064 | 11/1981 | Lawson | 166/97.5 |
| 4,333,531 | 6/1982 | Lawson | 166/341 |
| 5,330,007 | 7/1994 | Collins et al. | 166/341 X |
| 5,366,017 | 11/1994 | Voss, Jr. | 166/368 |

FOREIGN PATENT DOCUMENTS 1362633 9/1964 France .

*Primary Examiner*—Frank Tsay
*Attorney, Agent, or Firm*—Bacon & Thomas, PLLC

[57] ABSTRACT

The subject of the present invention is an oil well production string hanger. A well comprises a production string, or tubing, through which the hydrocarbons flow, and a casing which supports the wall of the well. Between the two, there is an annular space used for control of the well. The tubing hanger fixed at the top of the well generally has two passages allowing communication with the tubing and with the annular space respectively. The invention relates to a tubing hanger with a single passage which gives access both to the tubing and to the annular space and allows the annular space to be plugged using a simple, economical, reliable and reversible method.

7 Claims, 6 Drawing Sheets

OIL WELL PRODUCTION STRING HANGER

BACKGROUND OF THE INVENTION

1. Field of the Invention

The object of the present invention is an oil well production string hanger.

2. Description of Related Art

An oil well comprises a production string or tubing through which the hydrocarbons flow from the reservoir rock as far as the surface, and a casing which supports the wall of the well. Between the two, there is an annular space used for the control of the well.

The tubing hanger is fixed at the top of the well, at ground level or on a platform if it is a well open to the air or alternatively at the bottom of the water if it is a sub-sea well. Its functions are to anchor the tubing at ground level, to make a seal with the well head situated above, and to allow the tubing and the annular space to be plugged when the well head is withdrawn, the well head being equipped with all the valves necessary for the safety and the opening and closing of the well.

The hanger generally has two passages allowing communication with the tubing and with the annular space respectively. It also comprises, especially for sub-sea wells, passages for hydraulic fluids and for electric cables for controlling the well bottom equipment (valves, sensors).

The hanger is housed beneath the production well head (or alternatively in the drilling well head used during the drilling phase which precedes the production phase).

When the production well head is to be replaced (or the drilling well head is to be withdrawn at the end of drilling), it is essential, for safety reasons, first of all to seal off the tubing and the annular space using plugs and thus regain the seal which was provided before by the safety valves in the well head.

There are, at the present time, two types of hanger: the directional type which is orientated with respect to the axis of the well, and the type which is concentric with this same axis. Each has two passages allowing communication with the tubing and with the annular space respectively. They differ essentially in the method used to seal the annular space.

For the directional type, the seal is provided by a plug lowered down on a cable. This is a reliable system which allows the plug both to be fitted and to be removed, but it requires the use of a double sub-sea intervention string, in the case of a sub-sea well: one for the annular space and one for the tubing, and this increases the duration of the operation and the cost of the equipment (hanger, well head and strings are more complicated and therefore more expensive).

For the concentric type of hanger, the device for sealing the annular space is installed at the same time as the hanger, and then activated by an automatic system as the production head is withdrawn. This is a simple and quick system which requires just one sub-sea intervention string, but requires the well head to be removed and the entire tubing to be reassembled in order to replace the sealing plug which cannot be recovered using a cable. The concentric hanger is not widely employed on account of these drawbacks.

SUMMARY OF THE INVENTION

The subject of the present invention is an oil well production string hanger which has a single passage allowing twofold access to the tubing and to the annular space in order to allow the annular space to be plugged by lowering down a plug on a cable giving a reliable seal with the possibility of replacing the plug without major intervention, while at the same time preserving the concept of the concentric hanger and of the single intervention string.

The present invention therefore proposes a hanger for an oil well production string (or tubing), through which string the hydrocarbons flow towards the surface of the well, the well comprising a casing for holding up the walls of the well and an annular space between the string and the casing, the hanger being equipped with a single passage for communicating with the production string, and being provided with two housings which are intended to accommodate sealing means, characterized in that the single passage gives access both to the means for sealing the production string and to the means for sealing the annular space.

The features and advantages of the present invention will emerge more clearly from reading the description given hereafter with reference to the appended drawings

BRIEF DESCRIPTION OF THE FIGURES OF DRAWINGS

DETAILED DESCRIPTION OF THE PREFERRED EMBODIMENT

Figure 1A:
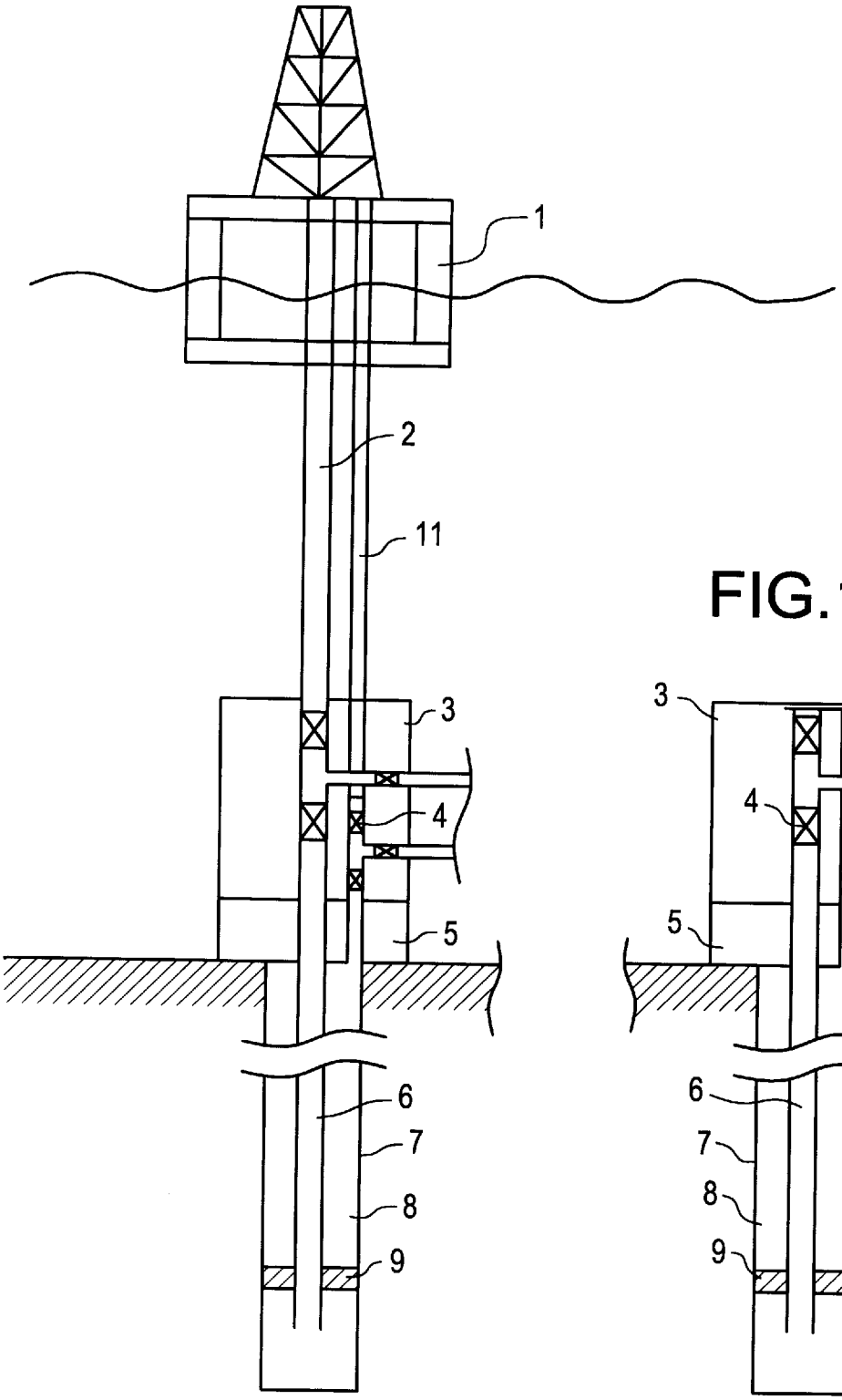
FIGS. 1A and 1B are each a section through a sub-sea oil well.

FIG. 1A is a section through a sub-sea oil well and shows a floating drilling or well intervention platform (1), an extension tube (2) which connects the platform to a sub-sea well head (3) fitted with safety valves (4).

A hanger (5) of a conventional type is situated beneath the production well head and supports a production string (6) (or tubing) and a casing (7) which are separated by an annular space (8). The annular space at the bottom of the well is sealed by seals (9) known as "packers".

The hanger is installed during the drilling/completion phase. At the end of this phase, the hanger remains in place and the drilling well head is replaced by a production well head.

In the case of a hanger of the directional type, which will be described in greater detail later, there is a second extension tube (11) connecting the platform to the annular space of the well. In the case of a hanger of the concentric type, there is no such second tube, as will be specified in the explanations which follow.

Figure 1B:
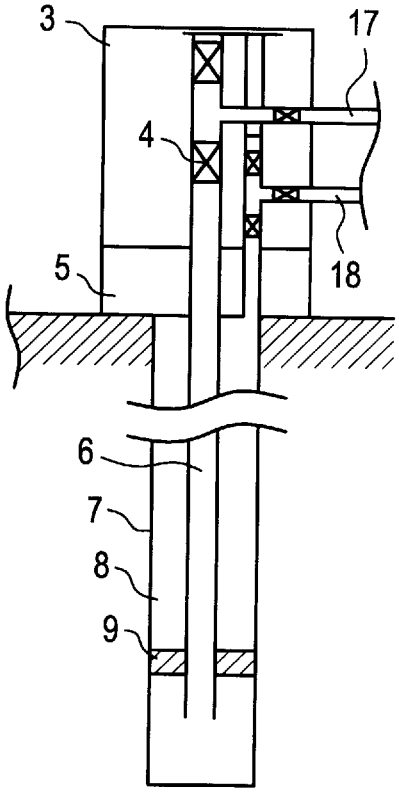

FIG. 1B is a section through a sub-sea oil well in normal production, the drilling or intervention gear having been withdrawn. The production pipe (17) allows the hydrocarbons produced to be removed, and the pipe (18) allows communication with the annular space.

Figure 2A:
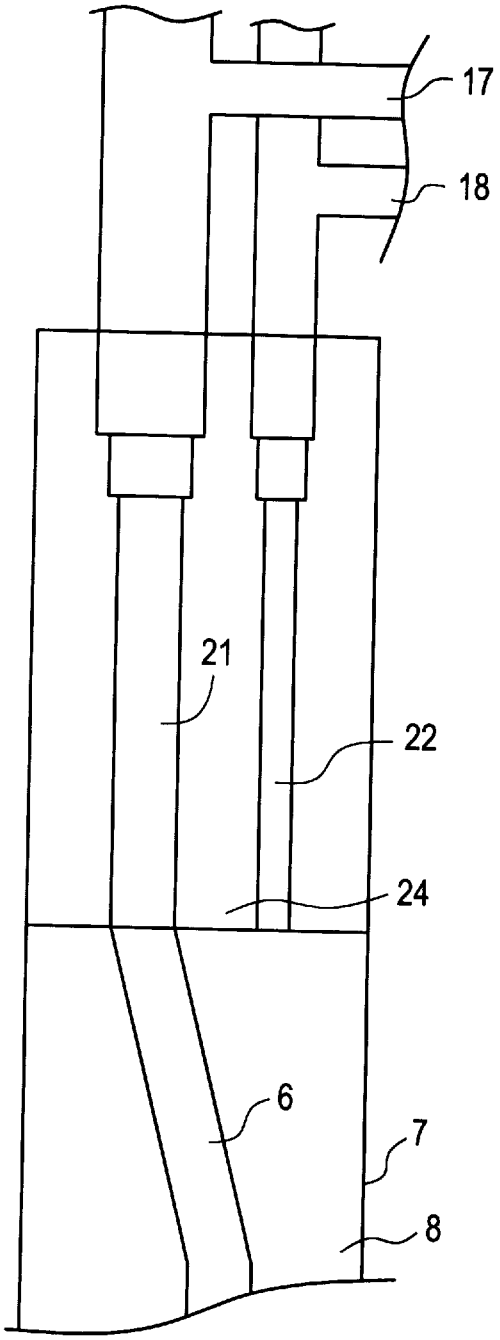
FIGS. 2A and 2B show a diagram of a conventional hanger of the directional type.

FIG. 2A represents a conventional directional tubing hanger in the production configuration. The two separate vertical passages (21), (22), one for the flow of hydrocarbons and one for access to the annular space, can be discerned, these passages being separated by the axis of the well (24).

This type of hanger needs to be orientated to make the passages of the hanger and those of the well head coincide; (forced orientation created by a finger interacting with a helical guide ramp).

Figure 2B:
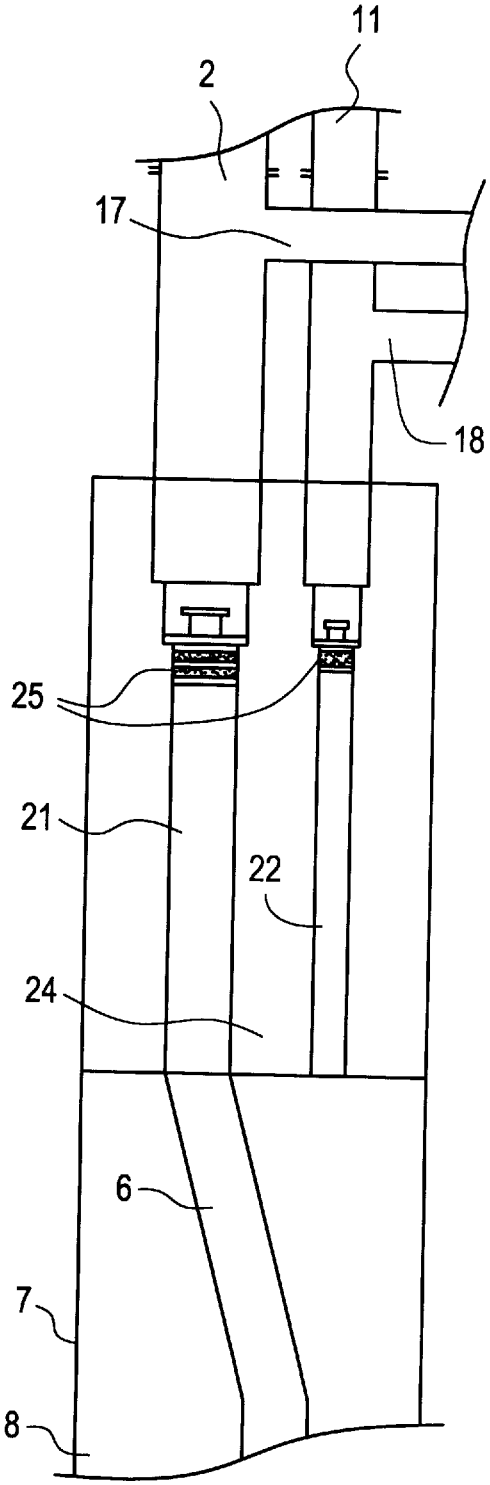

When the well is not producing, FIG. 2B, the two passages are plugged by sealing means, for example plugs (25) installed using a cable (not represented) lowered down into the well. After plugging, the well head situated above can then be repaired or replaced and the plugs then removed using the same method. The two extension tubes (2), (11) allow access to the passages (21), (22) and to the sealing means.

Figure 3A:
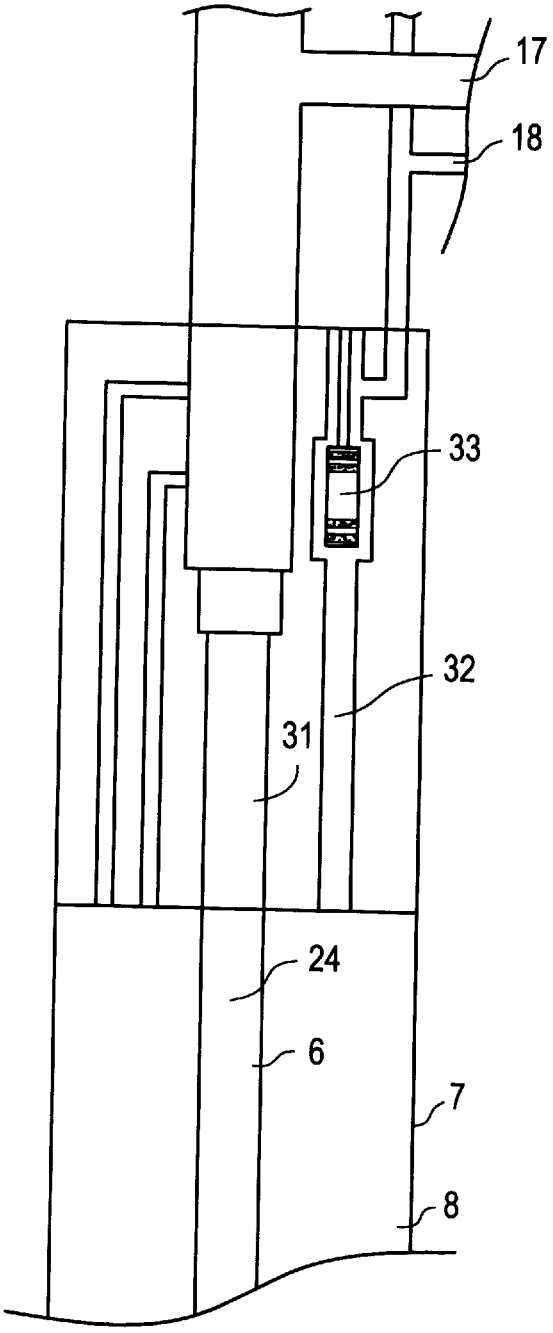
FIGS. 3A and 3B show a diagram of a conventional hanger of the concentric type.

FIG. 3A represents a conventional tubing hanger of the concentric type in the production configuration. The axis (24) of the well is coincident with the axis of the tubing (6). A check valve (33) is preinstalled in the passage (32) which remains open and in communication with the pipe (18); this check valve cannot then be replaced unless the hanger and the entire tubing is first dismantled.

Figure 3B:
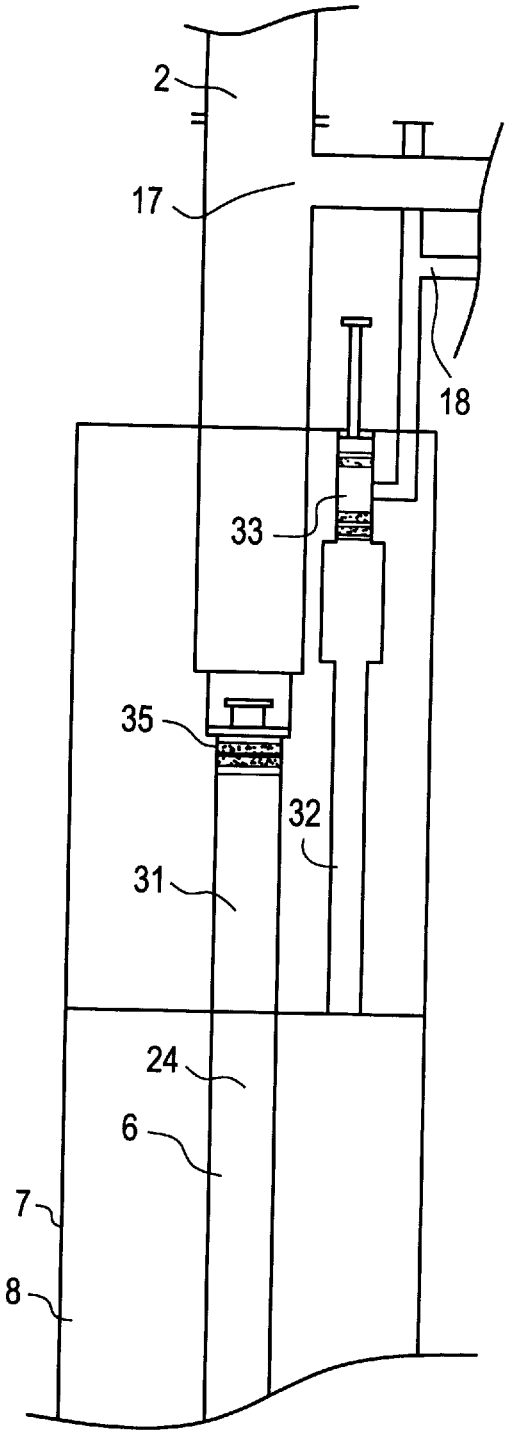

In the configuration for intervention on the well, FIG. 3B, the well not producing, only the vertical passage (31) of the tubing is surmounted by an extension tube (2) allowing the plug (35) to be fitted. The vertical passage (32) of the annular space is not surmounted by an extension tube. The check valve (33) is closed automatically under the action of a spring (not represented) as the well head is withdrawn. Despite the simplicity of the concentric hanger, the fact that it is not possible to replace the check valve (33) for the annular space constitutes a major drawback for the safety of the well because of the wear brought about by the corrosive environment in which the plug is situated.

Figure 4A:
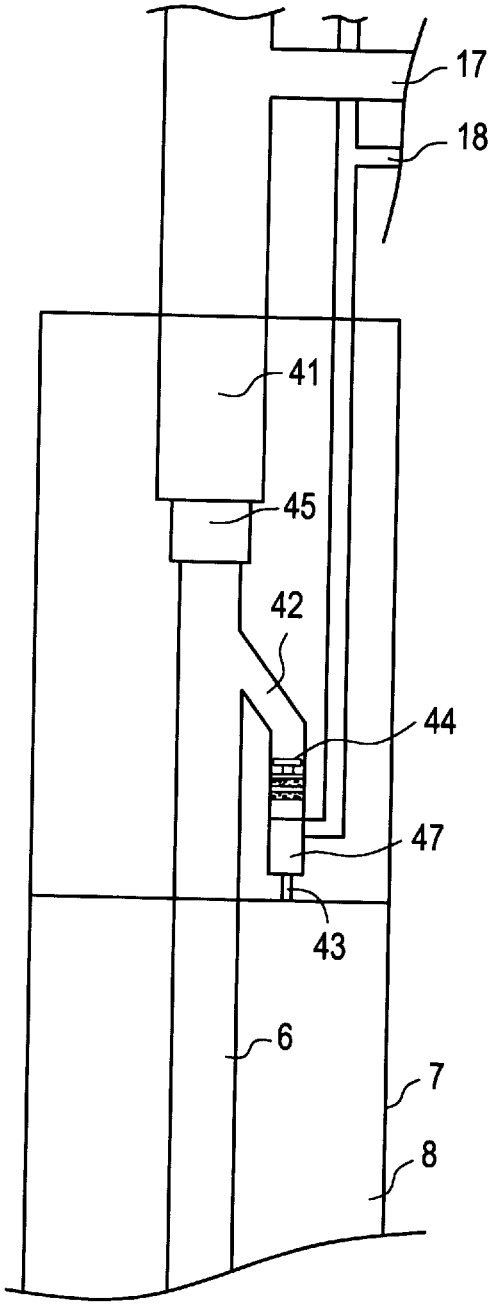
FIGS. 4A and 4B show a diagram of a hanger, the subject matter of the invention, of the concentric type with access to the annular space.
Figure 4B:
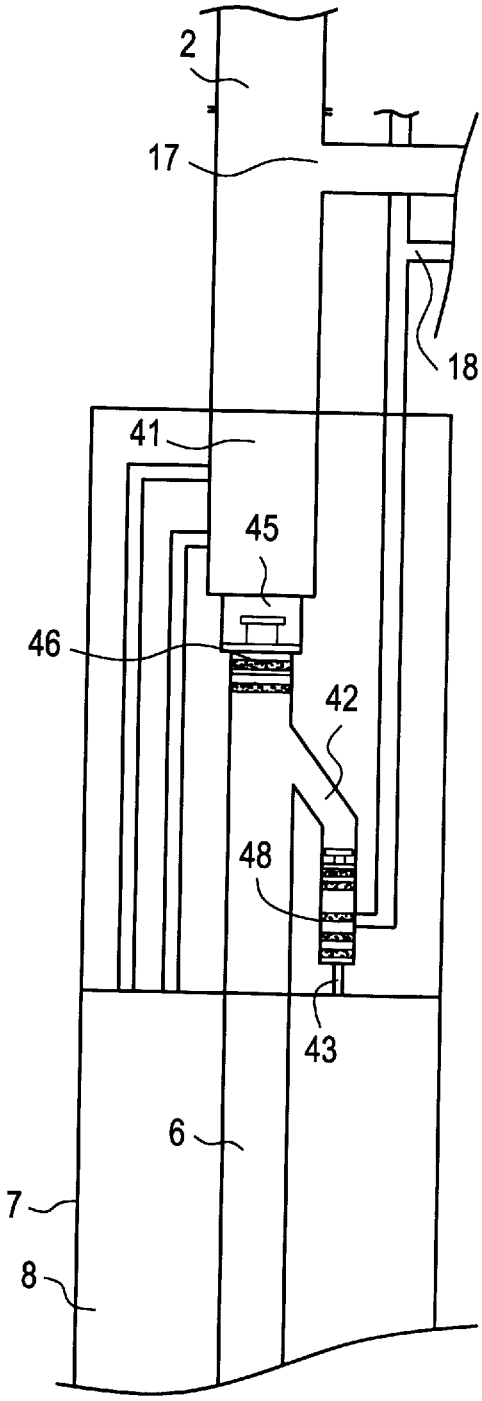

The invention proposed is shown in FIGS. 4A and 4B. The hanger which forms the subject of the invention has just a single passage (41) between the well head situated above and the well situated below, this passage being formed by an extension of the tubing. According to the invention, this passage (41) comprises a branch (42) which starts from the single passage (41) and allows access to the system for sealing the annular space.

FIG. 4A shows a diagram of the hanger in production mode, that is to say when the well is delivering. There are no plugs sealing the passage (41). A plug (44) for sealing the branch (42), which plug is preinstalled in a housing (47) designed for this, prevents communication between the tubing (6) and the annular space (8) but allows communication between the pipe (18) and the annular space, via the orifice (43).

In the mode where work is being carried out on the well, that is to say when the well is not producing, as represented in FIG. 4B, two plugs (46), (48) plug the tubing and the annular space respectively. The tubing plug (46) lies in a housing (45) formed in the tubing. The branch plug (44) has been replaced, in the housing (47), by the plug (48) for the annular space; this plug is longer than the plug (44) because it provides a seal, on the one hand, between the annular space (8) and the tubing (6), and on the other hand between the annular space (8) and the pipe (18).

Figure 5A:
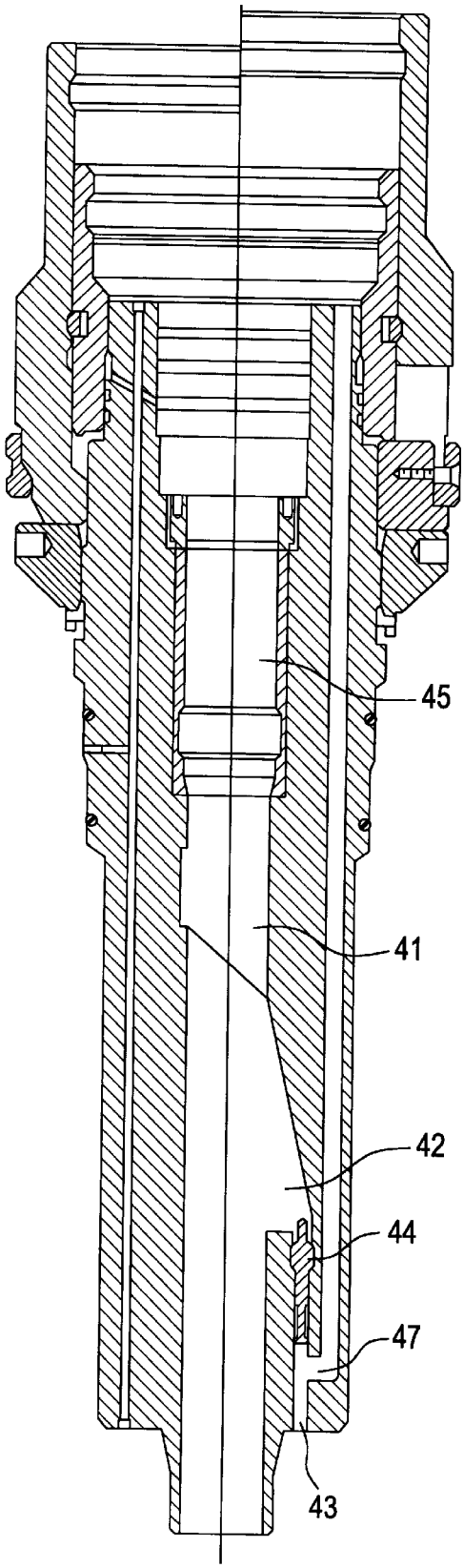
FIGS. 5A and 5B are each actual sectional views through a hanger which is the subject of the invention.
Figure 5B:
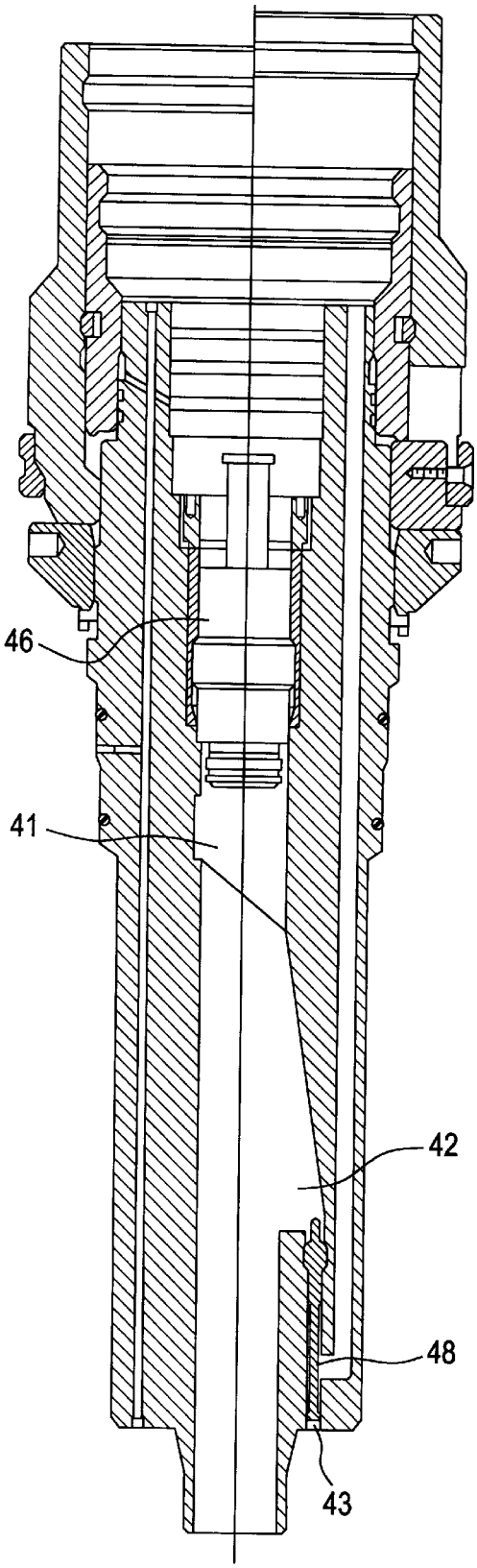

FIGS. 5A and 5B show sectional views, these being actual views rather than diagrammatic ones, of hangers in the production configuration (FIG. 5A) and configuration for working on the well (FIG. 5B), in which views the hanger components already described in the diagrams can be seen.

Fitting the plug (48) for the annular space includes the following phases:

the branch plug (44) is preinstalled, before the production string is lowered down, in the housing (47) formed in the branch (42)

should it be decided to plug the annular space, the plug (44) is withdrawn by means of the cable, and the new plug (48) is fitted into the housing (47) via the branch and still by means of the cable.

The plugs (44) and (48) as well as the plug (46) can be withdrawn and refitted using the cable, operated from the platform for intervention on the sub-sea well.

The sealing means which consist of the plugs (44), (46), (48), are arranged in such a way that they can be moved or replaced using a cable operated from an intervention platform, if the well is a sub-sea well. They have hooks for attaching them to the cable.

There are other possibilities for sealing the annular space which make it possible to simplify the device with the two plugs. For example, one could use a single plug the same size as the plug (48) which would simply be moved using the cable to make it seal the orifice (43). In this way the operations of raising the plug (44) and lowering down the plug (48) would be avoided.

The tubing hanger with single passage is an invention making it possible to plug the annular space using a simple, economical, reliable and reversible method.

I claim:

1. Hanger for a production string in an oil well, the well comprising a casing, a production string within the casing and an annular space defined between the production string and casing, said hanger comprising a single passage for communicating with the production string, a first housing for receiving means for sealing the production string and a second housing for receiving means for sealing the annular space, wherein the single passage gives access both to the means for sealing the production string and to the means for sealing the annular space.

2. The hanger according to claim 1, wherein access to the means for sealing the annular space is through a branch passage from the single passage.

3. The hanger according to claim 2, wherein the housing for receiving the sealing means for the annular space is disposed in the branch passage.

4. The hanger according to claim 3, wherein said sealing means comprises a plug for sealing the branch passage, thus preventing any communication between the production string and the annular space when the well is producing.

5. The hanger according to claim 1, further comprising sealing means arranged in said first and second housings such that they can be moved or replaced using a cable.

6. The hanger according to claim 2, further comprising an annular pipe which communicates with the annular space.

7. The hanger according to claim 6, wherein during interventions on the well, means for sealing the annular space are installed in said second housing and blocks both communication between the annular space and the annular pipe and communication between the annular space and the production string through said branch passage.

* * * * *